US010519694B2

(12) United States Patent
Lin et al.

(10) Patent No.: US 10,519,694 B2
(45) Date of Patent: Dec. 31, 2019

(54) DEADBOLT TOUCH PANEL FOR KEYLESS ENTRY

(71) Applicant: Spectrum Brands, Inc., Middleton, WI (US)

(72) Inventors: James Lin, Laguna Niguel, CA (US); Jing Lin, Xiamen (CN); Byron Son Quach, West Covina, CA (US)

(73) Assignee: Spectrum Brands, Inc., Middleton, WI (US)

( * ) Notice: Subject to any disclaimer, the term of this patent is extended or adjusted under 35 U.S.C. 154(b) by 15 days.

(21) Appl. No.: 15/477,477

(22) Filed: Apr. 3, 2017

(65) Prior Publication Data

US 2017/0284131 A1 Oct. 5, 2017

Related U.S. Application Data

(60) Provisional application No. 62/316,869, filed on Apr. 1, 2016.

(51) Int. Cl.

| | |
|---|---|
| ***E05B 47/00*** | (2006.01) |
| ***E05B 49/00*** | (2006.01) |
| ***E05B 17/10*** | (2006.01) |
| ***G07C 9/00*** | (2006.01) |

(52) U.S. Cl.

CPC ..... *E05B 47/00* (2013.01); *E05B 17/10* (2013.01); *E05B 49/00* (2013.01); *G07C 9/00174* (2013.01); *G07C 9/00944* (2013.01); *E05B 2047/0048* (2013.01); *E05B 2047/0072* (2013.01); *G07C 9/0069* (2013.01); *G07C 2009/00642* (2013.01)

(58) Field of Classification Search

CPC ..... E05B 47/00; E05B 2047/0048; E05B 2047/005; E05B 2047/0054; E05B 2047/0057; E05B 2047/0058; E05B 2047/0067; E05B 2047/0069; E05B 2047/0072; E05B 49/00; E05B 17/10

See application file for complete search history.

(56) References Cited

U.S. PATENT DOCUMENTS

| | | | | |
|---|---|---|---|---|
| 5,609,051 | A * | 3/1997 | Donaldson | E05B 47/0673 340/5.54 |
| 5,887,467 | A * | 3/1999 | Butterweck | E05B 41/00 292/144 |
| 6,116,066 | A * | 9/2000 | Gartner | E05B 41/00 292/348 |
| 6,760,964 | B1 * | 7/2004 | Gartner | G07C 9/00944 29/464 |
| 9,303,433 | B2 * | 4/2016 | Chiou | E05B 49/00 |
| 9,424,700 | B2 * | 8/2016 | Lovett | G07C 9/00174 |
| 9,487,971 | B2 * | 11/2016 | Quach | E05B 47/0012 |

(Continued)

*Primary Examiner* — Christopher J Boswell

(74) *Attorney, Agent, or Firm* — Merchant & Gould P.C.

(57) ABSTRACT

A touch screen electronic deadbolt includes a planar, exterior touch panel with a touch overlay for receiving tactile input for entry of an access code to engage and disengage a deadbolt. The touch panel is contained within a housing cavity of a rectilinear housing. A touch overlay rests above the housing cavity extending to the edge of the housing without the use of a bezel or frame, thus providing a sleek and low profile appearance. An interior escutcheon may be in communication with the exterior touch panel allowing a user to manually engage and disengage the deadbolt from within a dwelling.

18 Claims, 16 Drawing Sheets

(56) References Cited

U.S. PATENT DOCUMENTS

| | | | | |
|---|---|---|---|---|
| 9,758,991 | B2 * | 9/2017 | Lin | E05B 47/00 |
| 2002/0056300 | A1 * | 5/2002 | Pierre | E05B 47/0688 70/303 A |
| 2016/0115713 | A1 | 4/2016 | Lin | |
| 2018/0171660 | A1 * | 6/2018 | Snider | E05B 17/10 |

* cited by examiner

DEADBOLT TOUCH PANEL FOR KEYLESS ENTRY

FIELD OF THE INVENTION

This invention relates to the field of security locks. More particularly, it relates to an electronic deadbolt controlled by a touch screen.

BACKGROUND OF THE INVENTION

Electronic deadbolts are well-known. Many electronic deadbolts include a keypad that allows users to enter a passcode to unlock the lock. In some cases, the keypads have physical buttons that the users press to enter passcodes while others include touch buttons or touch screens that operate on capacitive touch. With a touch screen lock controller, the keypad is able to sense touches of the user's finger on the keypad surface without the mechanical parts of a physical button. The user may engage the deadbolt and disengage the deadbolt through tactile input into the lock controller via the touch screen.

These touch screens are often installed on the exterior portion of an entry door. In the event of a power outage, touch screen lock controllers are known to include a mechanical key bypass accessible on the exterior portion of the entry door. The mechanical key bypass allows the user to use a physical key to engage and disengage the same deadbolt controlled by the touch screen. This allows a fail-safe measure to gain entry in the event of a power outage or malfunction of the electronic lock.

Mechanical key bypasses also add to the overall size of the deadbolt requiring a larger use of space on the exterior surface of the door. The increased use of the door surface limits aesthetic designs such as glass accents, millwork, or carvings that may be included on the door surface. Mechanical key bypasses also add to the overall complexity and cost associated with the deadbolt.

Known electronic deadbolts that use touch screens use a touch overlay that is surrounded by and protected by a bezel. The bezel acts as a barrier to protect the overlay from impact and also shields the perimeter from moisture, as it is installed on the exterior of a door. These bezels also add to the overall size of the touch screen, which as mentioned above is undesirable.

What is therefore needed is an electronic deadbolt that uses a reduced amount of the door surface. What is also needed is an electronic deadbolt that incorporates a touch screen without a mechanical key bypass. Finally, what is needed is an improved, exterior, compact touch screen for operating an electronic deadbolt.

SUMMARY AND OBJECTS OF THE INVENTION

An electronic deadbolt controller preferably includes a planar, exterior touch panel. The touch panel is preferably used in all-weather conditions. The touch panel is also preferably in the shape of a square with flat sides. A touch overlay may form a face of the touch panel and receive tactile input from a user. The tactile input may be received by a flexible printed circuit board secured to the touch overlay.

To assist in displaying a numeric key pad, a diffuser may be secured to the flexible printed circuit board opposite the touch overlay. A spacer may further be secured to the diffuser opposite the flexible printed circuit board. A rigid printed circuit board may include light emitting diodes and be secured to the spacer opposite the diffuser. Preferably, a PCB housing contains the components of the touch pad within sides formed by a PCB housing cavity. The touch overlay preferably rests above the PCB housing cavity and is secured with an adhesive sealing the components within.

A second housing may be used to accept the PCB housing within a housing cavity formed by four sides of the second housing cavity thus allowing the PCB housing to nest within. An opening in the rear surface of the touch panel may be sealed, preferably with an epoxy, therefore preventing any moisture from entering the touch panel.

An interior escutcheon may be attached to the touch panel with fasteners and a cable allowing communication, or be in remote communication. A battery storage compartment is preferably included within the interior escutcheon to deliver power the electronic deadbolt controller. A set of battery terminals may also extend from the exterior of the second housing in electrical communication with the lock controller configured to accept an external battery to power the electronic deadbolt controller when the battery storage compartment fails to power the electronic deadbolt controller.

The second housing may be secured to the PCB housing with a tenon in the second housing cavity configured to mate with a mortise in the PCB housing.

The touch overlay may also include an electroluminescent material configured to both illuminate the touch panel and also detect the tactile input.

Preferably, the electronic deadbolt controller does not include a mechanical key bypass on an exterior side of the door and instead uses a battery backup with the battery terminals.

A plurality of tactile input traces may also be used by programing them into the electronic deadbolt controller or they may be physically embedded into the touch overlay thus allowing for a thinner touch panel. In such an example, the touch overlay would preferably be glass but any known touch overlay material may be used.

The touch overlay also preferably includes equal length sides that each extend beyond a perimeter of the PCB housing. The PCB housing may be formed with at least three equal length sides that are each shorter than the equal length sides of the touch overlay. The second housing also preferably includes sides that are each equal in length to the touch overlay sides. The equal length sides of the touch overlay thus align with and are flush to the equal length sides of the second housing when the touch panel is assembled.

The touch panel may be assembled with a conformal resin to secure the flexible printed circuit board, the diffuser, the spacer, and the rigid circuit board within the housing cavity, or double sided tape and adhesives may be used.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

DETAILED DESCRIPTION

Figure 1:
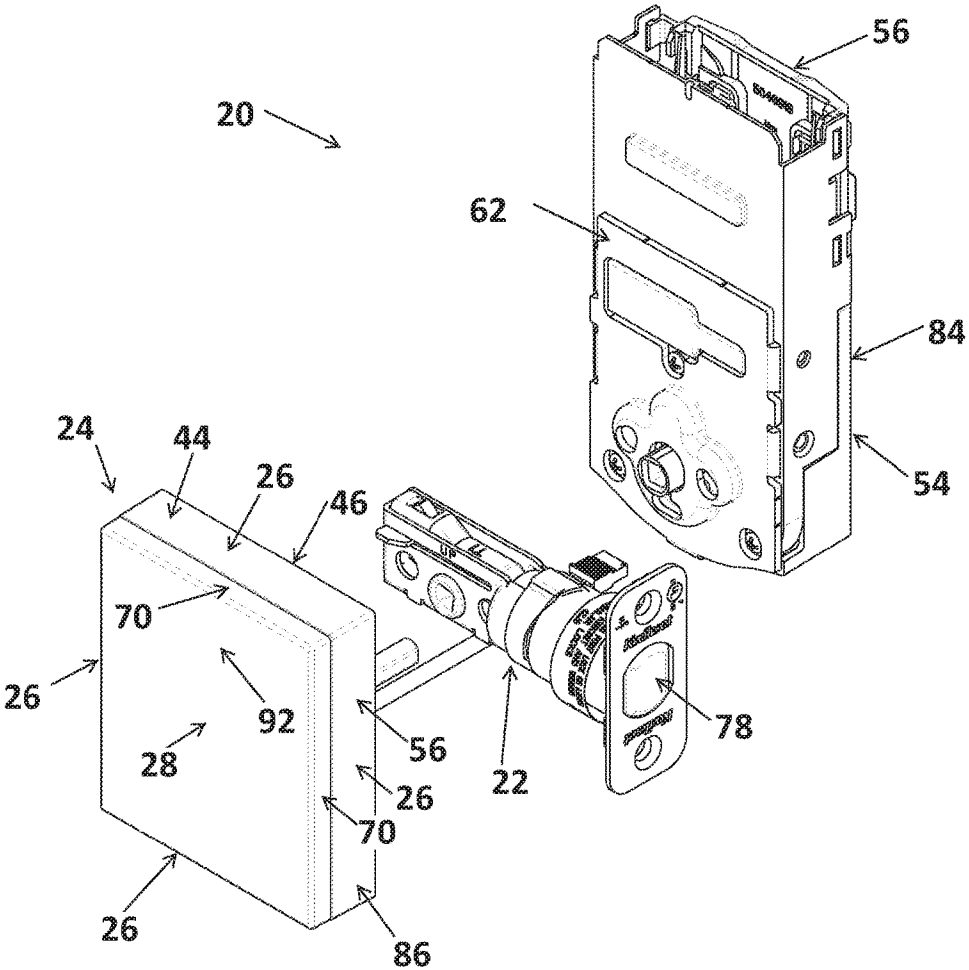
FIG. 1 is a raised perspective view of an exemplary electronic deadbolt with a touch panel for keyless entry according to one embodiment of the invention.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well-known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring to FIG. 1, an electronic deadbolt controller 20 is shown according to one embodiment of the invention. The electronic deadbolt controller 20 includes a touch panel 24, electronic deadbolt 22, and an escutcheon 54. The touch panel may be mounted on an exterior surface and exposed to the elements. The escutcheon 54 may be mounted on an interior of a dwelling. The electronic deadbolt 22 engages and disengages a deadbolt 78 following input provided by a user into either the touch panel 24 or the escutcheon 54.

The touch panel 24 preferably receives input in the form of tactile touch from a user. A touch overlay 28 is provided on the front portion of the touch panel 24 and may illuminate to display a number pad. The user may enter an access code by manually entering a numeric code onto the touch overlay 28. A logo 92 may also selectively illuminate to either identify the origin of the invention or to communicate various messages to the user. For example, the logo 92 may illuminate in white to indicate an operational status, red for a malfunction, flash to indicate an incorrect/correct attempt to enter an access code, or any other color/flashing combination. The touch overlay 28 need not be limited to illuminating a numeric pad, but may include alpha numeric characters and symbols. The touch overlay 28 may also illuminate to display messages or video to allow for communication with a remote person or computer system. In this instance, a camera may be incorporated either directly on the touch panel 24 or integrated via a wire or wireless control.

In any instance, the preferred embodiment of the touch panel 24 includes a flat, planar touch overlay 28 that has equal length sides 26 forming a uniform, square shape. The touch panel 24 sides 26 are formed by the touch overlay 28 and the exterior 86 of the housing 44. The touch overlay 24 has sides 70 that are uniform in length, line up to, and are flush with the sides 46 of the housing 44. This produces a sleek and uniform shape with a flat front and sides.

Figure 2:
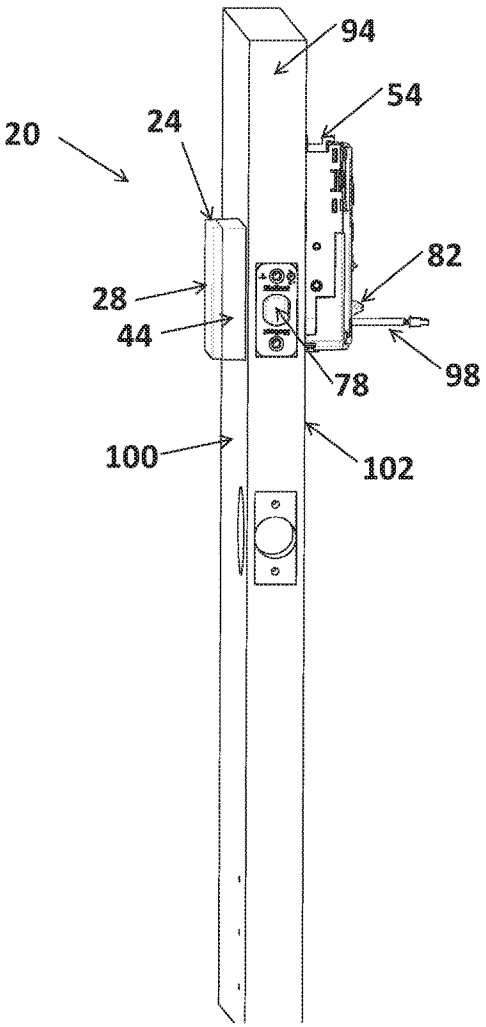
FIG. 2 is a side view of the electronic deadbolt of FIG. 1, as configured in a typical installation in an entry door.

Referring now to both FIG. 1 and FIG. 2, the electronic deadbolt controller 20 is preferably installed with the touch panel 24 on an exterior side 100 of a door 94. The escutcheon 54 is also preferable installed on the interior side 102 of the same door 94. An interior turn piece 82 may be included on the escutcheon 54 allowing an occupant within the dwelling to engage or disengage the deadbolt 78 manually, without necessitating an access code. The interior turn piece 82 may mechanically engage the deadbolt or it may energize the electronic deadbolt 22 and causing it to engage. A cable 98 is preferably used, allowing the touch panel 24 to communicate with both the electronic deadbolt 22 and the escutcheon 54. The cable 98 may pass through the door 94 through a hole cored into the door between the escutcheon 54 and the touch panel 24. Alternatively, any known wireless protocol may be used, allowing the touch panel 24 to communicate with the electronic deadbolt 22, and escutcheon 54. By using a wireless protocol, a user could mount the touch panel 24 anywhere or even use a pre-existing device, such as a smart phone to operate the electronic deadbolt 22.

In order to prevent unauthorized access to the escutcheon 54 from the exterior side 100 of the door 94, a hardened steel plate 62 may be inserted between the door 94 and the escutcheon. The steel plate 62 provides anti-drilling features in the event the touch panel 24 is dislodged from the door 94. An added security measure includes forming the housing 44 out of a durable alloy and using fasteners extending through the door 94 to join the housing 44 to the escutcheon 94.

Figure 3:
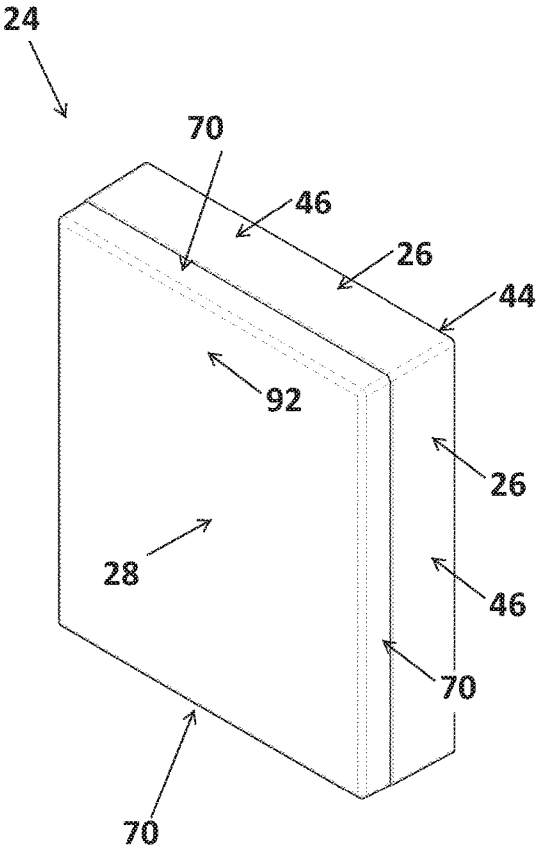
FIG. 3 is a raised perspective view of a touch panel of the electronic deadbolt of FIG. 1.

Turning now to FIG. 3, the touch panel 24 is shown in isolation. As previously discussed, the touch panel preferably includes a flat touch overlay 28 that rests on top of a housing 44. The touch overlay 28 extends flush to the sides 46 of the housing, such that the sides 70 of the touch overlay 28 and the sides 46 of the housing are flush along the entire perimeter of the sides 26 of the touch panel 24.

Figure 4:
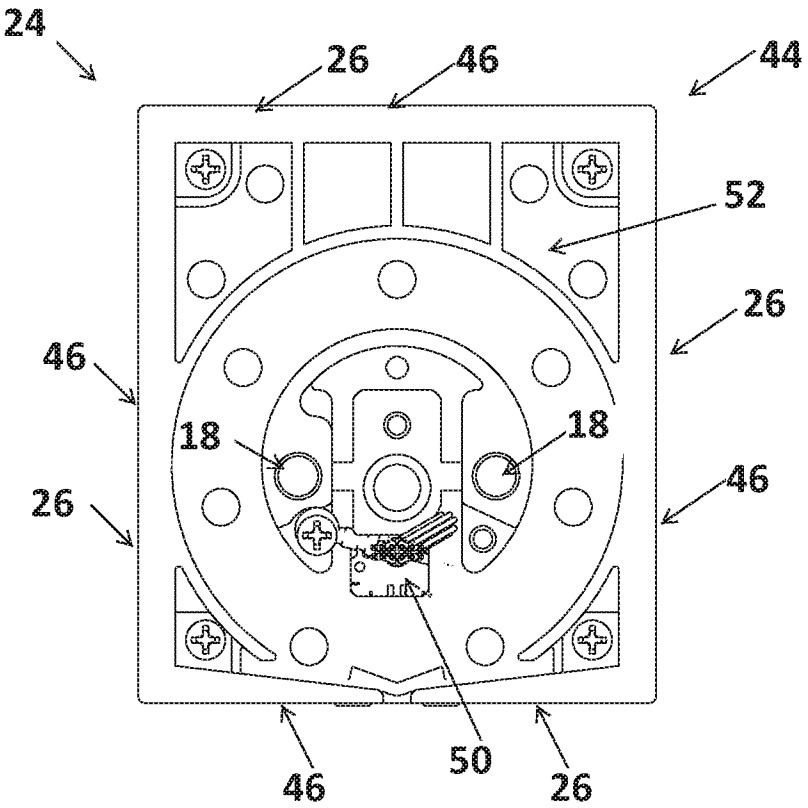
FIG. 4 is a back view of the touch panel of FIG. 3.

FIG. 4 expands on the touch panel 24 showing the rear surface 52 of the housing 44. An opening 50 is preferably included in the housing 55 and touch panel 24 allowing the previously-mentioned cable 98 to pass through. As the touch panel 24 is intended to be mounted on an exterior side 100 of a door 94 (see FIG. 2 for example), the opening 50 is preferably sealed to prevent moisture from rain, snow, or air humidity from entering the housing 44. The seal may be any known substance but is preferably a cured resin in the form of an epoxy. Supports 18 may be included on the rear surface 52 of the touch panel 24 and rest within the door 94 for added support. Fasteners may use the supports 18 as anchor points and thread into the supports pulling both the escutcheon 54 and the touch panel 24 against the interior side 102 and exterior side 100 of the door, respectively (see FIG. 2 for example). As the rear surface 52 of the touch panel 24 and housing 44 is generally flat, the touch panel 24 rests flush against the door 94 with the supports 18 extending into a pocket (not shown) within the door. As the touch panel 24 is flush against the exterior side 100 of the door 94, this provides an added security feature preventing an unauthorized user from using a pry bar between the touch panel 24 and the door 94.

Figure 5:
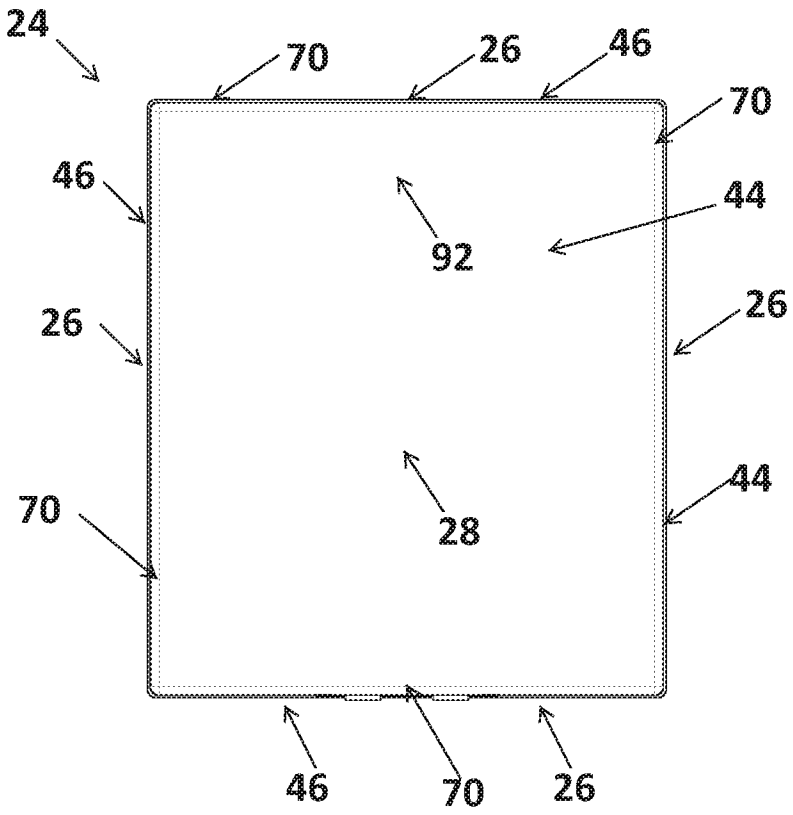
FIG. 5 is a front view of the touch panel of FIG. 3.
Figure 6:
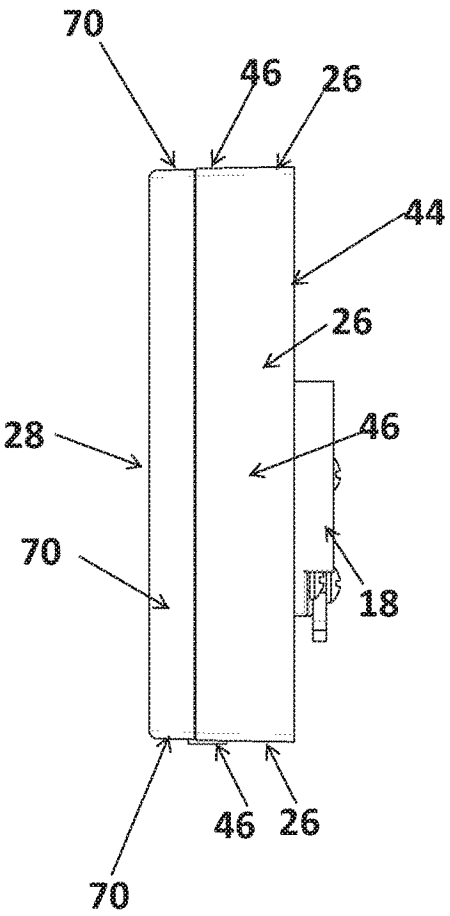
FIG. 6 is a side view of the touch panel of FIG. 3.

FIGS. 5 and 6 detail the sleek, uniform profile of the touch panel 24. The touch overlay 28 includes a profile formed by sides 70 that uniformly line up with and are flush to the sides 46 of the housing 44. This produces a touch panel 24 that does not require a bezel to make-up for any differences between the respective sides of the touch overlay 28 and the housing 44. The lack of any bezel also eliminates the use of a border around the touch overlay 28 as shown in FIG. 5. In fact, from a front view of the touch panel 24, the housing 44 is not visible as the touch overlay extends right up to the sides 46 of the housing 44.

Figure 7:
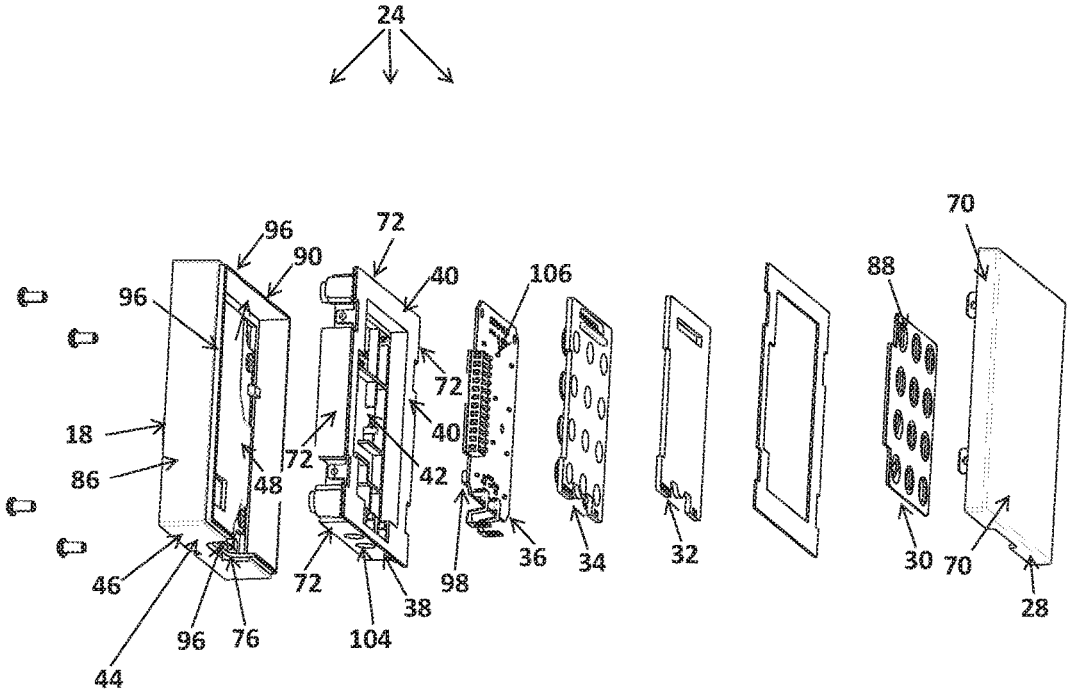
FIG. 7 is an exploded view of the touch panel of FIG. 3 showing a touch overlay, flexible printed circuit board, diffuser, spacer, rigid printed circuit board, PCB housing, and the housing.

As there is no bezel surrounding the touch overlay 28, the touch panel 24 preferably does not use any visible gasket between the housing 44 and the touch overlay. Instead, as shown in FIG. 7, the touch panel 24 uses an adhesive 88 between the touch overlay 28 and the housing 44. The adhesive 88 is shown in FIG. 7 in the form of stippling, but may include a liquid adhesive, a double sided tape adhesive, a conformal resin adhesive, or any other known adhesive used in the art of touch screen assembly. Preferably, the touch overlay 28 is secured to a flexible printed circuit board 30 with adhesive 30. The flexible printed circuit board 30 is then bonded to a diffuser 32. The diffuser 32 diffuses light projected from light emitting diodes 106 on a rigid printed circuit board 36. The light is passed through a spacer 34 prior to the diffuser which concentrates the light into desired patterns and shapes. Each one of these layers of the touch panel 24 may be secured to one another with an adhesive 88. As previously discussed, the touch panel may also incorporate video or display other messages. As a result, the touch panel is not intended to be limited to the components discussed herein. As touch screen technology advances, different printed circuit boards are envisioned that may not require as many layers, thus allowing for a thinner profile.

Preferably, the various layers of the touch panel 24 are contained within a PCB housing 38. The PCB housing 38 includes sides 40 that form a PCB housing cavity 42. The PCB housing cavity 42 is shaped such that the rigid printed circuit board 36, the spacer 34, the diffuser 32, and the flexible printed circuit board 30 are all contained within the PCB housing cavity 42. Each one of these components sits completely within the PCB housing cavity 42 such that they are not visible from a side view. This allows the touch overlay 28 to rest on the PCB housing sides 40 around the entire perimeter of the PCB housing 38. The adhesive 88 therefore seals the components within the PCB housing cavity 42. Once contained within the PCB housing cavity 42 the PCB housing 38 may be inserted within the housing 44 within the housing cavity 48.

To assist in securing the PCB housing 38 within the housing 44, a tenon 76 extends from the housing cavity 48. The tenon 76 on the housing 44 is inserted into a mortise 44 on the PCB housing 38. The tenon 76 of the housing 44 projects from a side 46 of the housing 44 and into the housing cavity 48. The mortise 104 likewise projects into the PCB housing cavity 42 from a single side 40 of the PCB housing 38. As a result, the exterior 86 of the housing 44 is flat and uniform on every side 46. The PCB housing 38 is flat and uniform on all sides 40 except for the side 40 with the mortise 104. Nevertheless, the length of each one of the sides 40 of the PCB housing are equal length allowing it to fit within the interior of the housing 44 within the housing cavity 48. Once inserted into the housing cavity 48, the perimeter 72 of the PCB housing 38 is contained flush with a front face 90 of the housing 44.

Figure 8:
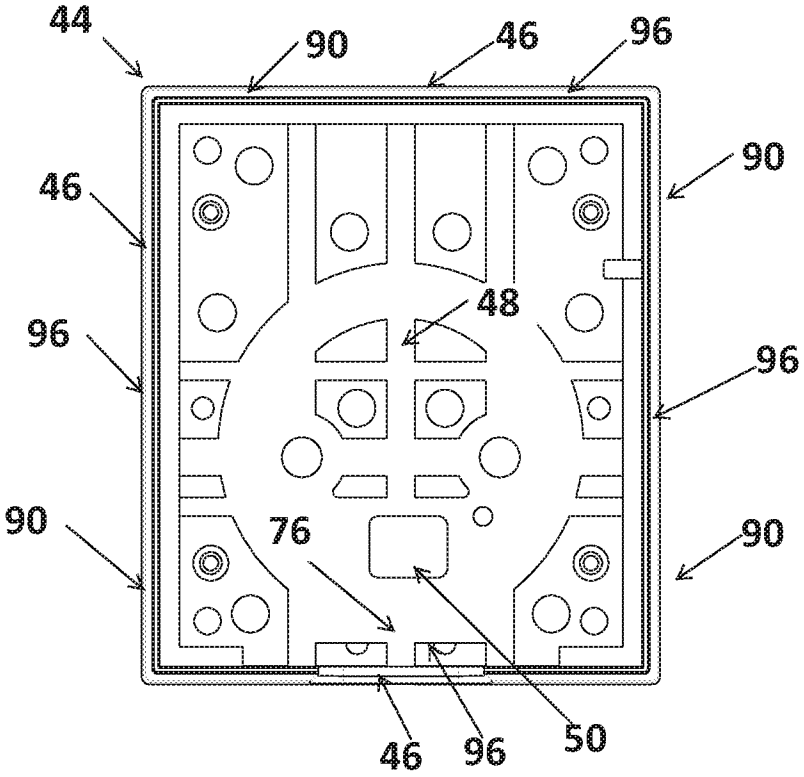
FIG. 8 is a front view of a housing of the touch panel of FIG. 3.
Figure 9:
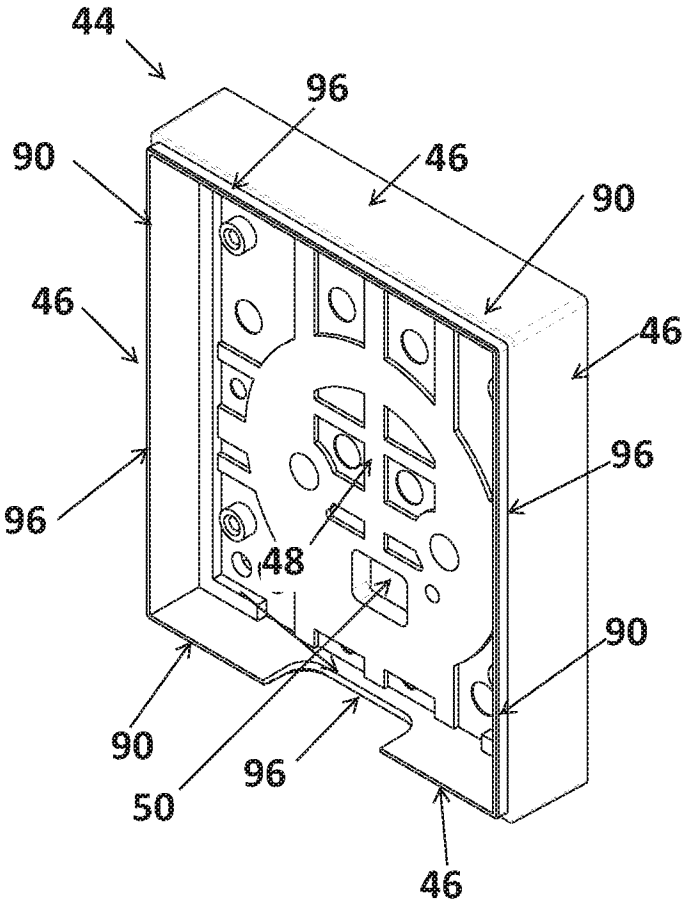
FIG. 9 is a perspective view of the housing of FIG. 8.

Turning now to FIG. 8 and FIG. 9, the housing 44 is shown in isolation with the PCB housing 38 removed. The housing cavity 48 is formed with smooth interior sides 46 with a single mortise 76 projecting into the housing cavity. The front face 90 of the housing 44 is also planar and evenly flat. This allows for an even and secure bond with the touch overlay 28 about the front face 90 with the use of an adhesive thus sealing the entire perimeter of the housing 44 with the touch overlay 28. As previously mentioned, an opening 50 in the rear of the housing 44 allows a cable 98 (see FIG. 2 for example) to pass through allowing communication with the escutcheon 54. The opening 50 is preferably filled with an epoxy sealing the opening from any moisture or foreign bodies and protecting the electric operation of the touch panel 24.

Figure 10:
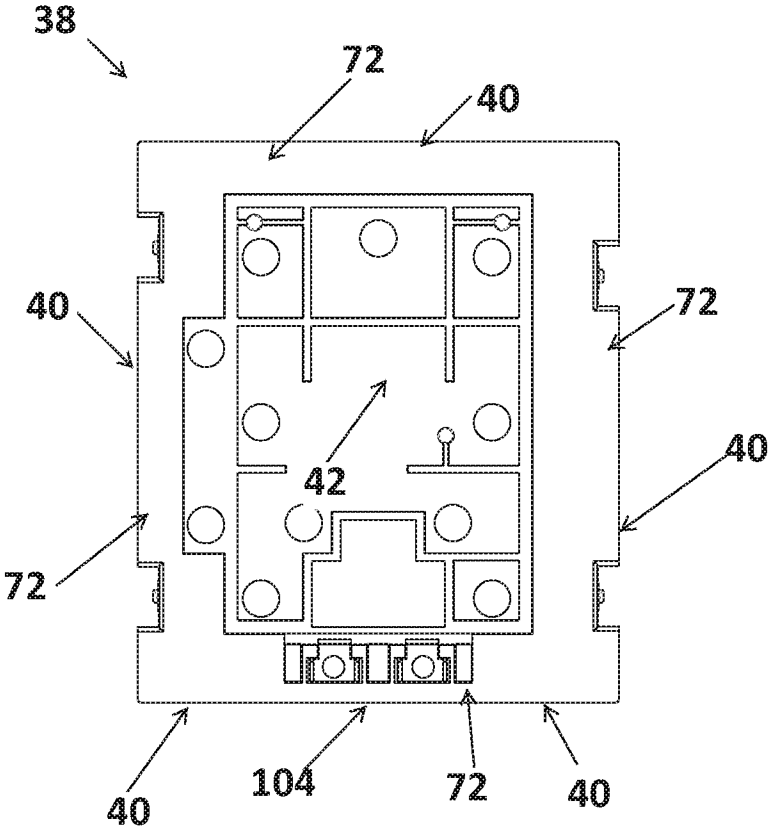
FIG. 10 is a front view of a PCB housing as shown in FIG. 7.
Figure 11:
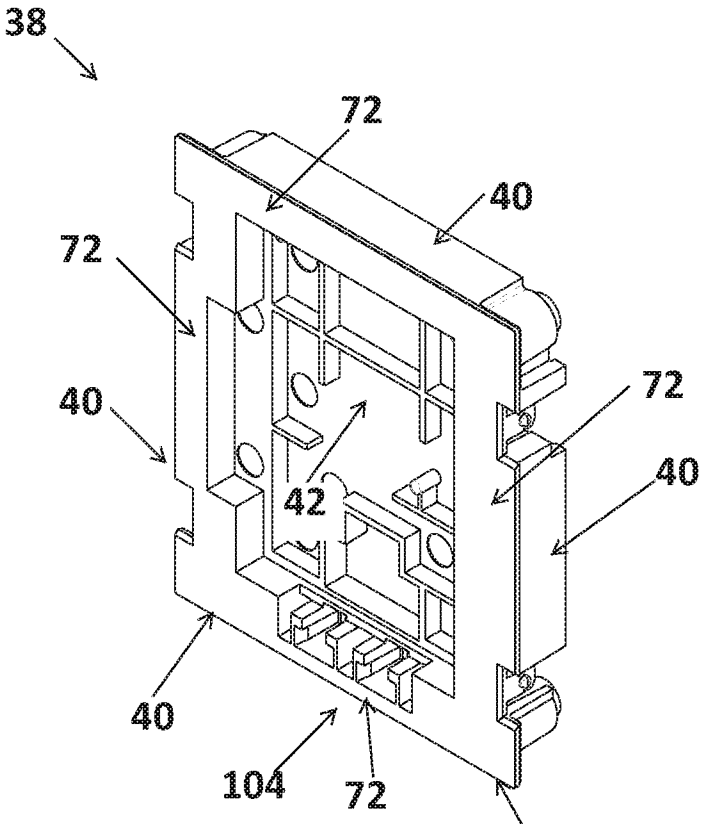
FIG. 11 is a perspective view of the PCB housing of FIG. 10.

Looking to FIG. 10, a front view of the PCB housing 38 shows the exterior profile that matches the interior profile of the housing 44 in FIG. 8. FIG. 11 also shows a perspective fire of the PCB housing 38. The sizes of PCB housing 38 and the housing 44 are not to scale. The PCB housing 38 is designed to fit within the interior of the housing cavity 48 such that the mortise 104 of the PCB housing 38 receives the tenon 76 of the housing 44 which as best shown in the exploded view of FIG. 7. The perimeter 72 of the PCB housing is also uniformly flat which allows the touch overlay 28 to be secured with adhesive about the perimeter 72 as discussed with respect to FIGS. 14-16.

Figure 12:
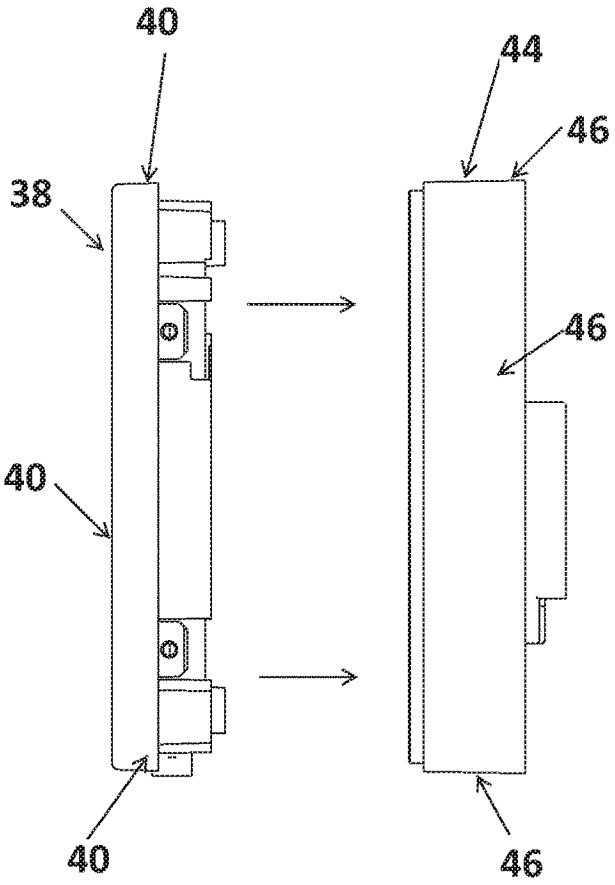
FIG. 12 is a side view of the PCB housing and the housing of FIG. 7.
Figure 13:
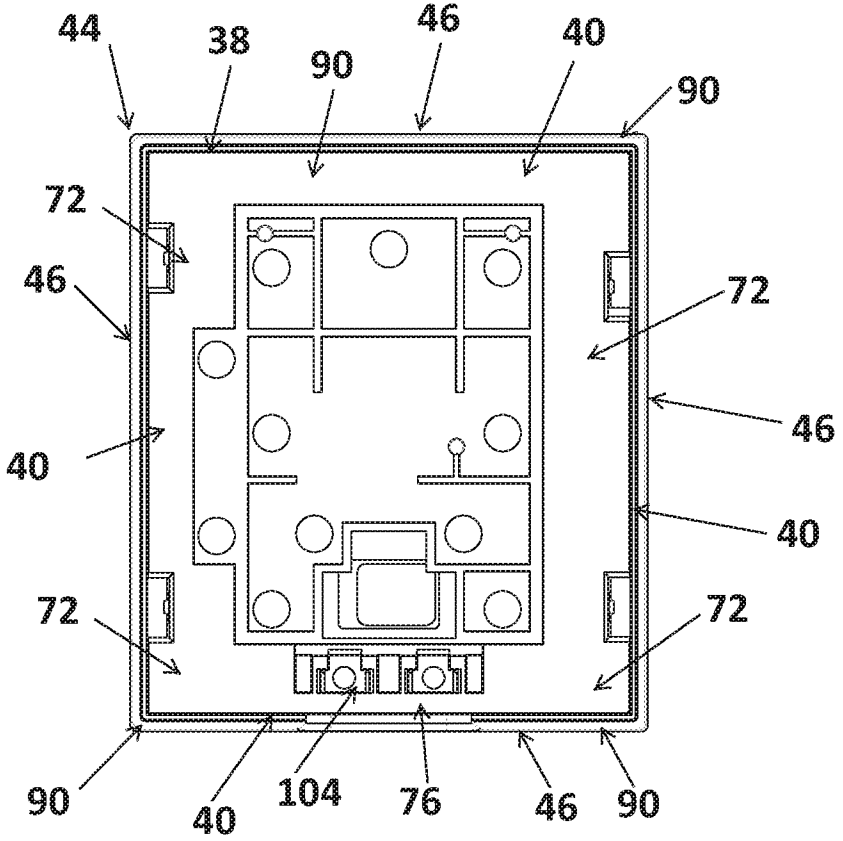
FIG. 13 is a front view of the PCB housing of FIG. 7 nested within the housing of FIG. 7.

FIGS. 12 and 13 show the PCB housing being inserted into the housing cavity 48 of the (main) housing 44. The sides 40 of the PCB housing fit uniformly within the housing cavity 48. The flexible printed circuit board 30, diffuser 32, spacer 34, and rigid printed circuit board 36 are not shown for simplicity's sake, but are all contained within the PCB housing 38 such that they would not be visible in the side view of FIG. 12. Once the PCB housing 38 is inserted within the housing cavity 48 the touch overlay 28 may be secured to both the perimeter 72 of the PCB housing and front face 90 of the housing 44 as best shown in FIG. 6.

Figure 14:
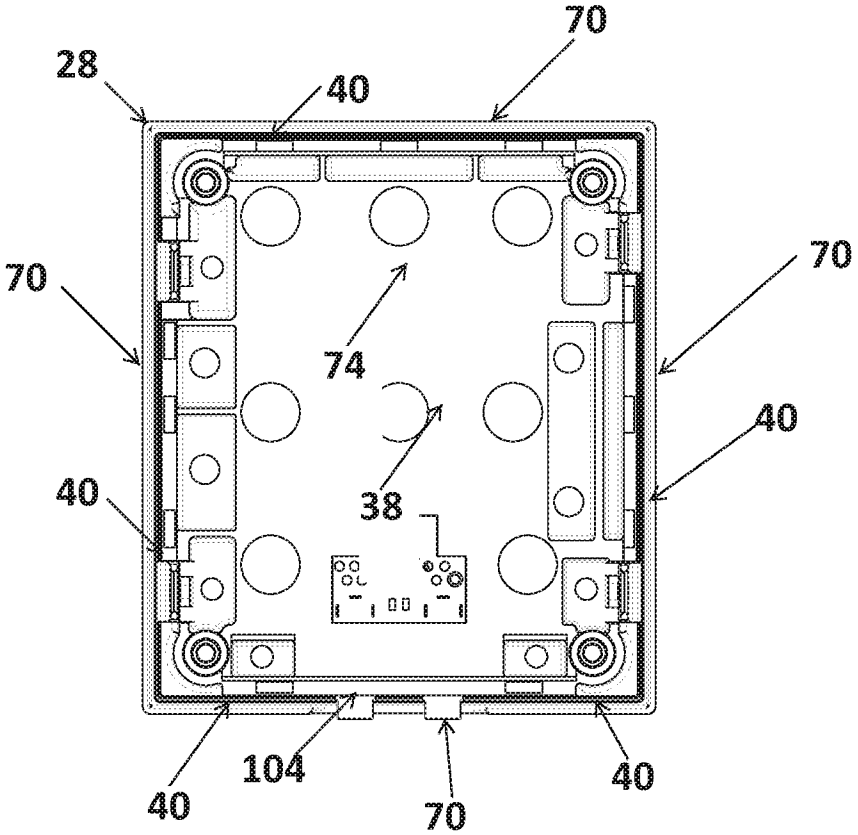
FIG. 14 is a back view of the PCB housing in the foreground assembled with the touch overlay in the background, as shown in FIG. 7.
Figure 15:
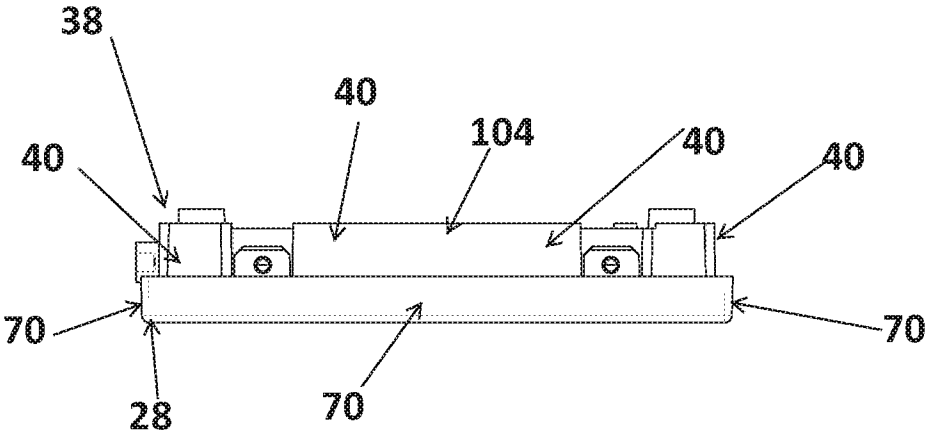
FIG. 15 is side view of the PCB housing assembled with the touch overlay as shown in FIG. 14.

As shown in FIG. 14 and FIG. 15, without the housing 44 the touch overlay 28 extends past the sides 40 of the PCB housing 48 on each one of the sides 40. Looking at the rear 74 of the PCB housing, the sides 70 of the touch overlay 28 remain exposed and projecting about the perimeter 72 of the PCB housing 38 which allows them to be securely fastened to the front face 90 housing 38, best shown in FIG. 7.

Figure 16:
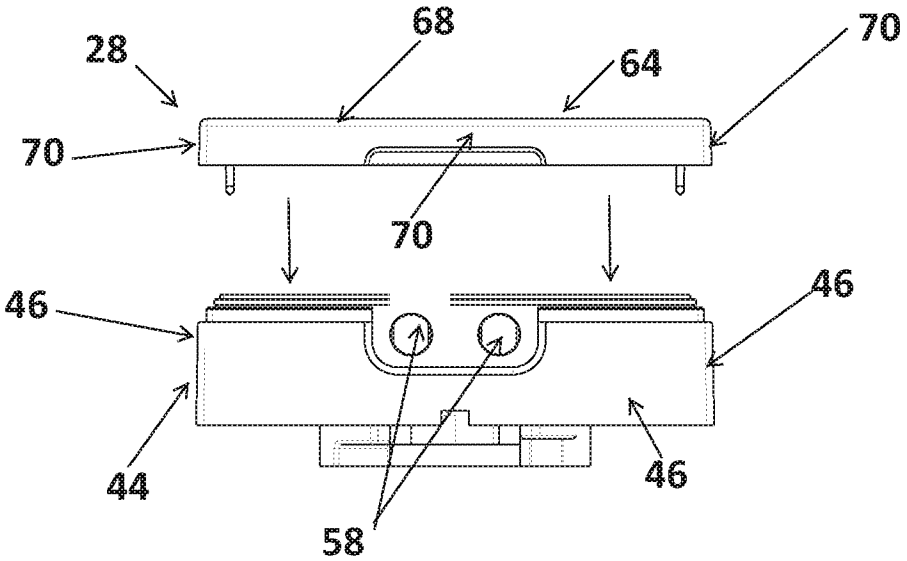
FIG. 16 is a side view of the housing with the touch overlay removed, as shown in FIG. 7.

When assembling the touch panel 24, the touch overlay 28 may be secured at the same time onto both the PCB housing 38 and the housing 44 after they are nested together as shown in FIG. 16. Alternatively, the touch overlay 28 may be first secured to the PCB housing as shown in FIG. 14 and then secured to the housing 44. It is also envisioned that the PCB housing 38 may be eliminated entirely. In such an embodiment, the flexible printed circuit board 30, diffuser 32, spacer 34, and rigid printed circuit board 36 may all be inserted directly into the housing 44. The touch overlay 28 may then encapsulate these components within the housing cavity 48 by being secured about the sides 46 of the housing.

Referring back to FIG. 16, the bottom of the housing 44 is shown which reveals a set of battery terminals 58. These battery terminals may be aligned with a hand-held battery 60 to provide power to the electronic deadbolt controller 20 in the event of a power outage. The battery terminals 58 preferably accept a common nine volt battery 60 but may be configured to accept any other battery or other form of auxiliary power. The electronic deadbolt controller is preferably powered by batteries contained within a battery storage compartment 56 of the escutcheon 54 (see FIG. 1 for example).

The escutcheon 54 may not only contain a battery storage compartment 56, but may also be configured to contain any number of accessories, such as a wireless protocol controller 84. Any one of the components of the touch panel 24 may also be removed from the housing 44 and moved within the escutcheon 54 allowing for an even smaller touch panel 24. The touch panel 24 may also include a touch overlay 28 constructed with an electroluminescent material 64 contained within the touch overlay 28 or on one side of the touch overlay 28. Such a construction would allow for a smaller housing 44 as the light emitting diodes contained on the rigid circuit board 36 would not be needed or may be smaller. Another alternative design may incorporate tactile input traces 68 which may be programmed into the electronic deadbolt controller 20 which would allow a user to trace shapes or patterns onto the touch overlay 28 as a form of access code.

When operating the touch panel 24, the user preferably may engage the deadbolt 78 simply by touching anywhere on the overlay 28 of the touch panel 24. A single touch may "awaken" the touch panel from a dormant sleep mode. While in a dormant sleep mode the touch panel 24 preferably does not illuminate and a number pad may not be visible. Once awoken with a single touch on the touch overlay 28, the number pad may then be visible. When the door 94 is in a closed position, waking the touch pad 28 may also automatically engage the deadbolt 78. This allows the user to lock the door 94 simply and easily when exiting the dwelling. Alternatively, the user may touch the touch overlay 28 to awaken the touch panel 24 and then press a lock button that illuminates.

It is also envisioned that the touch panel 24 may include a physical button. The button may either sense tactile touch through capacitive sensing or through haptic feedback allowing the user to physically depress the button. As indicated by lock symbol, pressing of the button may cause the deadbolt 78 to engage. The button 106 may be depressed along a parting line allowing displacement of the button as it is pressed. Should the user desire the deadbolt 78 to disengage, the access code is preferably entered into the touch panel 24.

The touch panel 24 may also use an illuminated keypad. The keypad includes a set of numbers ranging from zero through nine allowing a user to input any combination of numbers as a pass code. The keypad may also include other symbols such as a check mark or battery symbol. Any other symbols may be used as well to convey messages to the user, indicate battery levels, indicate malfunctions, and indicate operational status. The logo may also be used to receive input or indicate operational status.

The numbers may be shown in random order each time the keypad is illuminated thus preventing a potential intruder from learning the access code by seeing residual fingerprints, marks, or wear on the touch panel 24. It is also envisioned that a single touch of the touch overlay 28 may engage the deadbolt 78 when the keypad is not illuminated.

For example, when the touch panel 24 has not received any tactile input for a predetermined time period, it may be configured to power down activating a sleep mode. When in such a sleep mode the keypad may not be visible and the touch panel 24 preferably appears blank. As a user exits a dwelling, the touch panel 24 may still be in sleep mode. Should the user desire to engage the deadbolt 78, the user may simply press the button or if the touch panel 28 does not include button the user may simple touch anywhere on the touch overlay 28 which awakens the touch panel 24 and automatically engages the deadbolt 78. As a result, the user may exit the dwelling leaving it in a secured state without the need to use a physical key, enter a code, or other cumbersome activity.

It is also envisioned that the touch panel 24 may be configured in other shapes in addition to the square shape shown. For example, the touch panel 24 may be round, rectangular, or triangular. In fact, any polygonal shape may be used. The keypad may also be illuminated in round patterns, triangular patterns, or any other patterns and need not be limited to a checkerboard like pattern.

We claim:

1. An electronic deadbolt comprising:

an exterior touch panel configured for exterior, all-weather use comprising:

a touch overlay configured to receive tactile input into the touch panel from a user, wherein the touch overlay comprises an electroluminescent material configured to both illuminate the touch panel and also detect the tactile input;

a top printed circuit board secured to the touch overlay;

a diffuser biased towards the top printed circuit board opposite the touch overlay;

a spacer biased towards the diffuser opposite the top printed circuit board;

a bottom printed circuit board adjacent the spacer and diffuser; and a PCB housing forming a PCB housing cavity configured to receive the touch overlay such that the top printed circuit board, the diffuser, the spacer, and the bottom printed circuit board are received within the PCB housing cavity, wherein the touch overlay rests above the PCB housing cavity; and a second housing with sides forming a second housing cavity configured to receive the PCB housing such that the PCB housing nests within the second housing cavity and the touch overlay rests above the second housing cavity;

wherein an opening in a rear surface of the exterior touch panel is sealed, therefore preventing moisture from entering the second housing.

2. The electronic deadbolt according to claim 1, further comprising:

an interior side escutcheon in communication with the exterior touch panel;

a battery storage compartment within the interior escutcheon configured to power the electronic deadbolt; and a set of battery terminals extending from an exterior of the second housing configured to accept an external battery to power the electronic deadbolt when the battery storage compartment fails to power the electronic deadbolt with a predetermined amount of voltage.

3. The electronic deadbolt according to claim 1, wherein the second housing includes a tenon within the second housing cavity configured to mate with a mortise in the PCB housing.

4. The electronic deadbolt according to claim 1, wherein the electronic deadbolt does not include a mechanical key bypass on an exterior side.

5. The electronic deadbolt according to claim 1, further comprising:

a plurality of tactile input traces embedded into the touch overlay, and wherein the touch overlay is glass.

6. The electronic deadbolt according to claim 1, wherein the touch overlay includes equal length sides that each extend beyond a perimeter of the PCB housing, and wherein the second housing includes sides that are each equal in length to sides of the touch overlay.

7. The electronic deadbolt according to claim 6, wherein the equal length sides of the touch overlay align with and are flush to the equal length sides of the second housing.

8. A touch screen electronic deadbolt comprising:

an exterior touch panel configured for all-weather use comprising:

a touch overlay configured to receive tactile input into the touch panel for engaging and disengaging the touch screen electronic deadbolt, wherein the touch overlay comprises an electroluminescent material configured to both illuminate the exterior touch panel and also detect the tactile input;

a printed circuit board adjacent the touch overlay;

a diffuser secured to the printed circuit board opposite the touch overlay;

a spacer adjacent the diffuser opposite the printed circuit board;

a bottom printed circuit board adjacent the spacer opposite the diffuser; and a housing with four sides forming a housing cavity configured to receive the exterior touch panel such that the printed circuit board, the diffuser, the spacer, and the bottom printed circuit board are received within the housing cavity, wherein the touch overlay rests above the housing cavity;

wherein an opening in a rear surface of the exterior touch panel is sealed, therefore preventing moisture from entering the housing;

wherein a conformal resin secures the printed circuit board, the diffuser, the spacer, and the bottom printed circuit board within the housing cavity; and an interior escutcheon in communication with the exterior touch panel comprising:

an interior turn piece extending from the interior escutcheon configured to engage and disengage the touch screen electronic deadbolt.

9. The touch screen electronic deadbolt according to claim 8, further comprising:

a battery storage compartment within the interior escutcheon configured to power the touch screen electronic deadbolt;

a wireless controller within the interior escutcheon configured to enable operation of the touch screen electronic deadbolt by remote, wireless control; and a set of battery terminals extending from an exterior of the housing configured to accept an external battery to power the touch screen electronic deadbolt when the battery storage compartment fails to power the touch screen electronic deadbolt with a predetermined amount of voltage.

10. The touch screen electronic deadbolt according to claim 8, wherein an adhesive secures the touch overlay along a front face of the housing.

11. The touch screen electronic deadbolt according to claim 8, wherein a perimeter of the touch overlay aligns with and is flush with a perimeter of the housing.

12. A keyless electronic deadbolt controller comprising:

an exterior touch panel configured for exterior, all-weather use comprising:

a deadbolt configured to lock and unlock for securing an entry door;

a touch overlay configured to receive tactile input into the exterior touch panel for locking and unlocking the deadbolt, wherein the touch overlay comprises an electroluminescent material configured to both illuminate the touch panel and also detect the tactile input;

a flexible printed circuit board mounted proximate the touch overlay;

a diffuser proximate the flexible printed circuit board opposite the touch overlay;

a spacer adjacent the diffuser and opposite the flexible printed circuit board;

a bottom printed circuit board adjacent the spacer opposite the diffuser; and a housing with sides forming a housing cavity configured to receive the touch panel such that the flexible printed circuit board, the diffuser, the spacer, and the bottom printed circuit board are received within the housing cavity with the touch overlay resting above the housing cavity;

wherein an opening in a rear surface of the exterior touch panel is sealed, therefore preventing moisture from entering the housing; and wherein an adhesive secures the touch overlay to a perimeter of the housing along the sides thus securing the flexible printed circuit board, the diffuser, the spacer, and the bottom printed circuit board within the housing cavity; and an interior escutcheon in communication with the exterior touch panel comprising:

an interior turn piece extending from the interior escutcheon configured to lock and unlock the deadbolt when manually manipulated.

13. The keyless electronic deadbolt controller according to claim 12, further comprising:

a front face formed by the sides of the housing, wherein the adhesive secures the touch overlay along the front face;

wherein the touch overlay aligns with and is flush with the sides of the housing.

14. The keyless electronic deadbolt controller according to claim 12, further comprising:

a PCB housing with sides forming a PCB housing cavity configured to receive the touch overlay such that the flexible printed circuit board, the diffuser, the spacer, and the bottom printed circuit board are received within the PCB housing cavity;

wherein the touch overlay rests above and extends beyond a perimeter of the PCB housing cavity.

15. The keyless electronic deadbolt controller according to claim 12, further comprising:

a PCB housing with at least two equal length sides forming a PCB housing cavity configured to receive the touch overlay such that the flexible printed circuit board, the diffuser, the spacer, and the bottom printed circuit board are received within the PCB housing cavity, wherein the touch overlay rests above the PCB housing cavity;

wherein the sides of the touch overlay extend beyond a perimeter of the PCB housing cavity; and wherein the housing receives the PCB housing such that the sides of the touch overlay rest above and evenly along the sides of the housing.

16. The keyless electronic deadbolt controller according to claim 12, further comprising:

a cable in electrical communication with the exterior touch panel and the interior escutcheon; and an opening in a rear surface of the housing allowing passage of the cable to the interior escutcheon;

wherein the opening in the rear surface of the housing is sealed, therefore preventing any moisture from entering the housing, and wherein the keyless electronic deadbolt controller does not include a mechanical key bypass on an exterior side.

17. The keyless electronic deadbolt controller according to claim 12, further comprising:

a set of battery terminals extending from an exterior of the housing in electrical communication with the keyless electronic deadbolt controller; and a battery storage compartment within the interior escutcheon configured to power the keyless electronic deadbolt controller, wherein the set of battery terminals are configured to accept an external battery to power the keyless electronic deadbolt controller when the battery storage compartment fails to power the touch screen with a predetermined amount of voltage.

18. An electronic deadbolt comprising:

an exterior touch panel configured for exterior, all-weather use comprising:

a touch overlay configured to receive tactile input into the exterior touch panel from a user;

a top printed circuit board secured to the touch overlay;

a diffuser biased towards the top printed circuit board opposite the touch overlay;

a spacer biased towards the diffuser opposite the top printed circuit board;

a bottom printed circuit board adjacent the spacer and diffuser; and a PCB housing forming a PCB housing cavity configured to receive the touch overlay such that the top printed circuit board, the diffuser, the spacer, and the bottom printed circuit board are received within the PCB housing cavity, wherein the touch overlay rests above the PCB housing cavity;

a second housing with sides forming a second housing cavity configured to receive the PCB housing such that the PCB housing nests within the second housing cavity and the touch overlay rests above the second housing cavity;

wherein an opening in a rear surface of the exterior touch panel is sealed, therefore preventing moisture from entering the second housing; and a plurality of tactile input traces embedded into the touch overlay, wherein the touch overlay is glass.

* * * * *